United States Patent [19]

Brennan

[11] Patent Number: 5,033,217

[45] Date of Patent: Jul. 23, 1991

[54] ROUND COUNTER FOR SMALL ARMS WEAPONS

[76] Inventor: Edward Brennan, 109 B. Bear Creek Rd., R.D. #1, Andover, N.J. 07821

[21] Appl. No.: 618,547

[22] Filed: Nov. 21, 1990

[51] Int. Cl.[5] ..... F41C 27/00

[52] U.S. Cl. ..... 42/1.01

[58] Field of Search ..... 42/1.01, 1.02

[56] References Cited

U.S. PATENT DOCUMENTS 3,453,882 7/1969 Kirkendall et al. ..... 42/1.01

4,541,191 9/1985 Morris et al. ..... 42/1.01

4,984,381 1/1991 Seifert ..... 42/1.01

*Primary Examiner*—Charles T. Jordan

*Attorney, Agent, or Firm*—Robert P. Gibson; Edward Goldberg; Michael C. Sachs

[57] ABSTRACT

A round or cycle counter for a weapon which utilizes a wear member operatively attached to the surface of a moving member which slidingly contacts a surface of a non-moving member of the weapon. A visual change in the wear means size or wear pattern enables one to calibrate the number of rounds fired or the safe life limit.

7 Claims, 2 Drawing Sheets

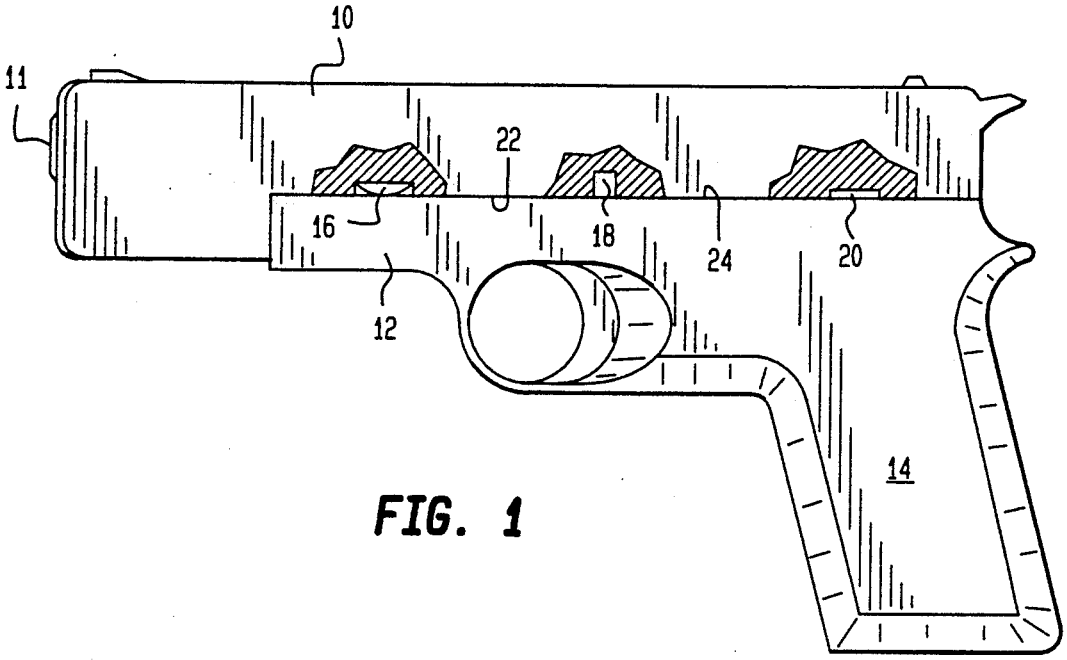
FIG. 1
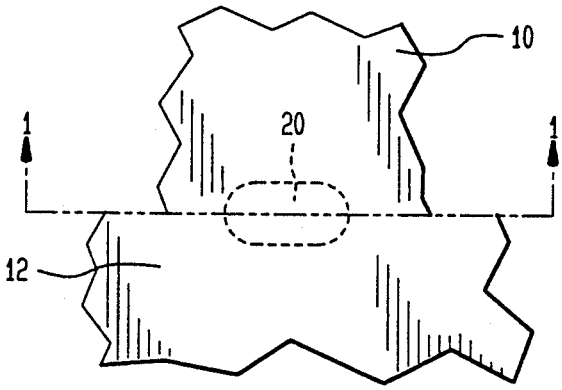
FIG. 2
FIG. 3 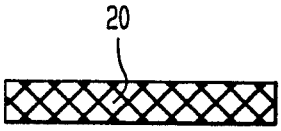
FIG. 4 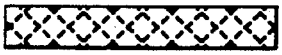
FIG. 5 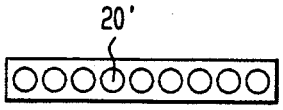
FIG. 6 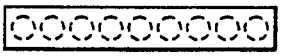

ROUND COUNTER FOR SMALL ARMS WEAPONS

GOVERNMENTAL INTEREST

The invention described herein may be manufactured, used and licensed by or for the Government for Governmental purposes without the payment to me of any royalty thereon.

BACKGROUND OF THE INVENTION

The present invention relates to the use of calibrated wear surfaces to act as round or cycle counter on small arms weapons, large caliber weapons and other military equipment that have critical end of life determination requirements.

In the past there was no finite way for the user to easily determine when a small arms weapon or a critical part of the weapon had reached the end of its safe useable life. The only sure way of determining the end of a part's or weapon's safe life previously was by doing a visual inspection at the depot level or when the weapon failed during firing. Frequently when failure occurs with a weapon during its use, the failure may result in serious injury or death to the user. Prior art devices do not provide the user with a readily descernible indicator to tell the user of a small arms weapon when the weapon has reached the end of its safe useable life. Another problem with the prior art devices was the requirement to keep an accounting record of the number of rounds tried on the weapon to ascertain when the weapon had reached its useable life. Keeping a log or record for the number of rounds fired was feasible for large caliber weapons but not feasible for small arm weapons.

SUMMARY OF THE INVENTION

The present invention relates to an improved means for visually allowing a user of small arms to easily determine when the weapon has reached the end of its safe life.

An object of the present invention is to provide a simple means for determining how many rounds have been fired or cycles completed on a weapon by using a system of calibrated wear indicator surfaces.

Another object of the present invention is to alert an armorer to easily determine when a weapon or a critical part thereof is at or near the end of its safe life cycle.

A further object of the present invention is to provide a means for calibrating wear surfaces to a given number of rounds acceptable for meeting a small arms specification during endurance firing tests.

For a better understanding of the present invention together with other and further objects, thereof, reference is made to the following descriptions taken in connection with the accompanying drawings.

BRIEF DESCRIPTION OF THE DRAWINGS

FIG. 1 is a plan view of a small arm with three different wear indicator means shown positioned in the reciprocating part of the weapon.

FIG. 2 is an enlarged partial cut-away section of the critical moving parts of a weapon showing the area of wear pattern location.

FIGS. 3 and 5 show the use of wear patterns which may be embossed or machined on the moving part of FIG. 2, taken along line 1—1.

FIGS. 4 and 6 show how the wear patterns of FIGS. 3 and 5 respectively would look as the weapon reached its safe life limit.

Throughout the following description, like reference numerals are used to denote like parts of the drawings.

DETAILED DESCRIPTION OF THE PREFERRED EMBODIMENTS

Figure 7:
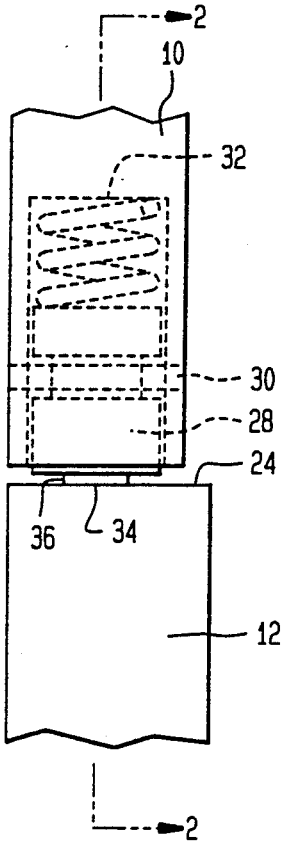
FIG. 7 is an enlarged side view of a wear plunger positioned between the sliding and non-sliding parts of a weapon.

Referring now to FIG. 1, disposed intermediate to a bolt slide 10 and a frame receiver 12 of pistol 14 are, shown for illustration purposes, three different round or cycle counters. Wear strip 16, wear plunger 18 and wear pattern 20 are placed where moving surface 22 of bolt slide 10 mates with the non-moving surface 24 of frame receiver 12. When the pistol 14 fires a round, not shown, from the barrel 11, the slide 10 moves rearward in recoil rubbing the wear surfaces of 16, 18 and 20 against the receiver 12 causing the wear surfaces to lose material and change in appearance.

Referring now to FIGS. 2–6, a wear pattern 20, 20' shown in FIGS. 3 and 5 respectively is embossed or machined on the critical moving part 10 that slides against the frame receiver 12. The wear patterns 20, 20' are three dimensional. As the surface wears away, the visual patterns of FIGS. 3 and 5 would change as shown in FIGS. 4 and 6, respectively, indicating the approximate number of rounds fired. Any pattern that changed with wear could be used and calibrated as a function of rounds fired and safe end of life.

Figure 8:
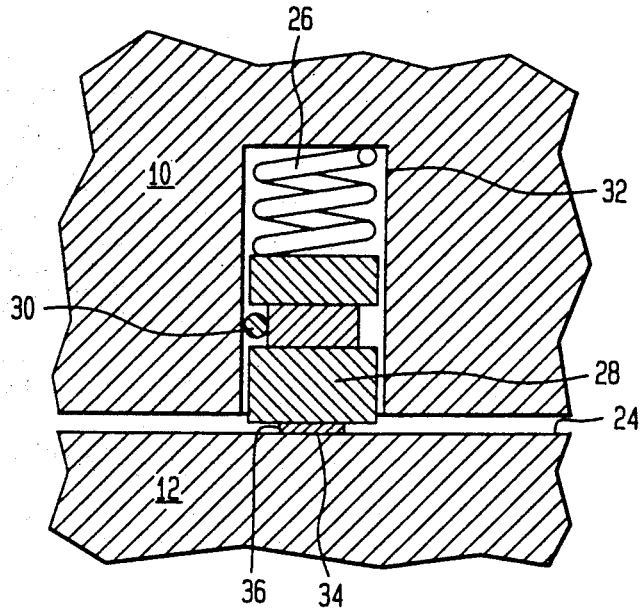
FIG. 8 is a cross-sectional view of the wear plunger of FIG. 7 taken along line 2—2.

Referring now to FIGS. 7 and 8, a spring 26 is held under compression by plunger 28 and pin 30 in a slide plunger counter bore 32 keeping wear plunger 34 in contact with the mating non-moving surface 24 during the firing cycle. The wear plunger 28 has a stepped down diameter section 36 at the contact surface 24. The wearing away of the stepped down diameter 36 would indicate the number of rounds fired. The wear patterns shown on FIGS. 3 and 5 could also be used on the wear plunger 34.

Figure 9:
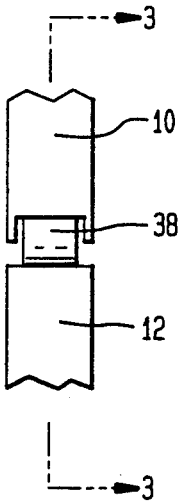
FIG. 9 is a partial view of a wear strip indicator positioned on the sliding and non-sliding parts of a weapon.
Figure 10:
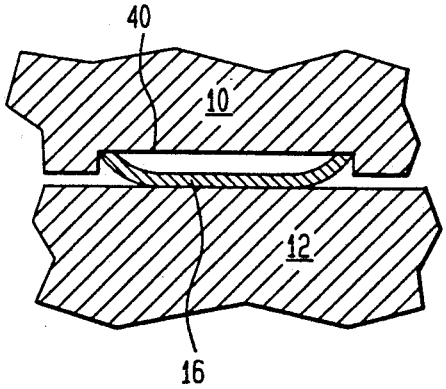
FIG. 10 is a cross-sectional view of the wear strip indicator taken along line 3—3 of FIG. 9.

Referring now to FIGS. 9 and 10, a compression loaded leaf spring 38 is operatively disposed in a slot 40 located in the underneath side of the bolt slide 10. The leaf spring 38 has a wear strip 16 in contact with the non-moving receiver frame 12 during the firing cycle. The thinning out of wear strip 16 and changes in pattern on the wear strip as illustrated in FIGS. 3–6 indicate the number of rounds fired.

In operation, the wear strip 20, the wear plunger 34 and the wear spring 16 are made of softer material than the parts they are designed to rub against to insure that they would wear first. Once the type of wear indicator surface type to be used is determined, the wear patterns are applied to the required surface by methods such as standard machining, chemical etching or milling, electrical discharge machining or plating.

The applications of the invention have been illustrated on a handgun between the receiver/frame and the slide. This invention can be used on any weapon and at any interface between reciprocating parts such as: barrel and bushing, bolt and receiver, hammer and slide or any other surfaces that slide past each other during the firing cycle.

This invention can also be used on machinerY other than weapons. It is important on some precision equipment to know when a maximum number of cycles have occurred for rebuild and maintenance planning.

While specific embodiments of the invention have been shown and described in detail to illustrate the application of the principles of the invention, it will be understood that the invention may be embodied otherwise without departing from such principles.

What is claimed is:

1. A round counter for small arms weapons which comprises:

bolt slide means for operatively supporting a barrel therein;

frame receiver means for holding said bolt means slideably attached thereto; and wear means operatively attached to said slide means and in sliding contact with said frame means for indicating the number of rounds fired and the safe life use of said weapon.

2. A round counter as recited in claim 1 wherein the wear means includes a wear strip operatively disposed on the bolt slide means surface which comes into sliding contact with said frame receiver.

3. A round counter as recited in claim 2 wherein said wear strip includes a visual wear pattern that is machined, chemically etched, milled, electrically machined or plated thereon.

4. A round counter as recited in claim 1 wherein the wear means includes:

a wear plunger operatively disposed in a counterbore located in said bolt slide means;

a compression spring for holding said wear plunger in juxtaposition with said frame receiver means.

5. A round counter as recited in claim 4 wherein said wear plunger further includes a wear pattern operatively disposed on the surface of said wear plunger that is in sliding contact with said frame receiver means.

6. A round counter as recited in claim 1 wherein the wear means includes a compression loaded leaf wear spring operatively disposed in a slot located in said bolt slide, said wear spring in sliding contact with said frame receiver means.

7. A round counter as recited in claim 6 wherein said leaf wear spring further includes a wear pattern operatively disposed on the surface of said wear leaf spring that is in sliding contact with said frame receiver means.

* * * * *